United States Patent [19]

Hansen

[11] 4,294,044

[45] Oct. 13, 1981

[54] TRACKING MECHANISM FOR A BELT TYPE SANDER

[75] Inventor: John M. Hansen, Dover Township, Racine County, Wis.

[73] Assignee: Emerson Electric Co., St. Louis, Mo.

[21] Appl. No.: 155,284

[22] Filed: Jun. 2, 1980

[51] Int. Cl.[3] ..... B24B 21/18

[52] U.S. Cl. ..... 51/135 BT; 51/148; 474/123; 474/135

[58] Field of Search ..... 474/123, 135; 51/135 R, 51/135 BT, 148

[56] References Cited

U.S. PATENT DOCUMENTS

| | | | |
|---|---|---|---|
| 2,313,254 | 3/1943 | Mead | 51/148 |
| 2,449,519 | 9/1948 | Sutton | 51/148 |
| 2,470,615 | 5/1949 | Grover | 51/135 BT |
| 2,706,367 | 4/1955 | MacCarthy | 51/148 |
| 2,780,033 | 2/1957 | Albright | 51/148 |
| 3,127,712 | 4/1964 | Krogen | 51/148 |
| 3,267,619 | 8/1966 | Den Herder | 51/148 |
| 3,335,528 | 8/1967 | Bader | 51/148 |
| 3,359,689 | 12/1967 | McCarty et al. | 51/170 EB |
| 3,608,245 | 9/1971 | Fair, Jr. et al. | 51/135 BT |
| 4,115,957 | 9/1978 | Porth et al. | 51/170 EB |

*Primary Examiner*—Harold D. Whitehead
*Attorney, Agent, or Firm*—Charles E. Markham

[57] ABSTRACT

An idler drum mounted for rotation on one end of a swinging arm is arranged to engage opposite sides of a sanding belt and to tension it in opposite directions when the arm is swung oppositely to first and second positions; belt tracking mechanism including spring means acting to tilt the arm laterally in one direction and first and second adjustment screws each positioned and arranged to engage the arm when in one of its first and second positions to adjustably limit the tilting of the arm in the one direction or to adjustably tilt the arm laterally in an opposite direction.

5 Claims, 6 Drawing Figures

TRACKING MECHANISM FOR A BELT TYPE SANDER

This invention relates to belt type sanding machines and particularly to belt tracking mechanism therefor.

BACKGROUND OF THE INVENTION

It is common practice to adjustably tilt the axis of rotation of an idler pulley or drum over which a sanding belt is trained so as to compensate for slight variations in the length of the edges of the belt and slight alignment errors in the machine which would otherwise cause the belt to run off center. However, in an arrangement wherein a swinging idler drum has two spaced positions in which it engages opposite sides of a sanding belt to tension it, thereby to facilitate diverse sanding operations, opposite tilting of the drum axis when in these positions is usually required to maintain belt tracking. It is also desirable that tracking mechanism for such an arrangement provides for independently adjusting the tilt of the idler drum axis for each of its two positions and further provides that such independent adjustments once made are automatically re-established when the idler drum is returned to either position.

THE PRIOR ART

U.S. Pat. Nos. 2,449,519; 2,470,615; 3,267,619; 3,359,689; 3,608,245 and 4,115,957 each disclose an idler drum mounted for rotation on a pivoted arm with adjustable belt tracking mechanism operative to variably tilt the idler drum axis either way from parallelism with the axis of a drive pulley either by adjustably tilting the arm or by tilting the drum shaft.

However, any prior disclosure of belt tracking mechanism providing for independently adjusting the tilt of a swinging idler drum when in either of two spaced belt tensioning positions and capable of re-establishing such adjustments when the drum is swung to either position is unknown to applicant or his representative.

OBJECTS OF THE INVENTION

It is an object of this invention to provide belt tracking mechanism for a belt type sanding machine in which diverse belt tracking adjustments may be independently applied to a swinging idler drum when in either of two spaced belt tensioning positions and in which such diverse adjustments are re-established when the idler drum is returned to either position.

A further object is to provide belt tracking mechanism for adjustably tilting the axis of rotation of a movable idler drum in opposite directions when in first and second positions of belt tensioning which includes spring means acting to tilt the axis in one direction, a first screw threaded means for adjustably limiting the tilting in the one direction when the idler drum is in the first position and a second screw threaded means for adjustably tilting the axis in an opposite direction when in the second position.

Further objects and advantages will become apparent when reading the following description in connection with the accompanying drawings.

THE DRAWINGS

DESCRIPTION AND OPERATION

Figure 2:
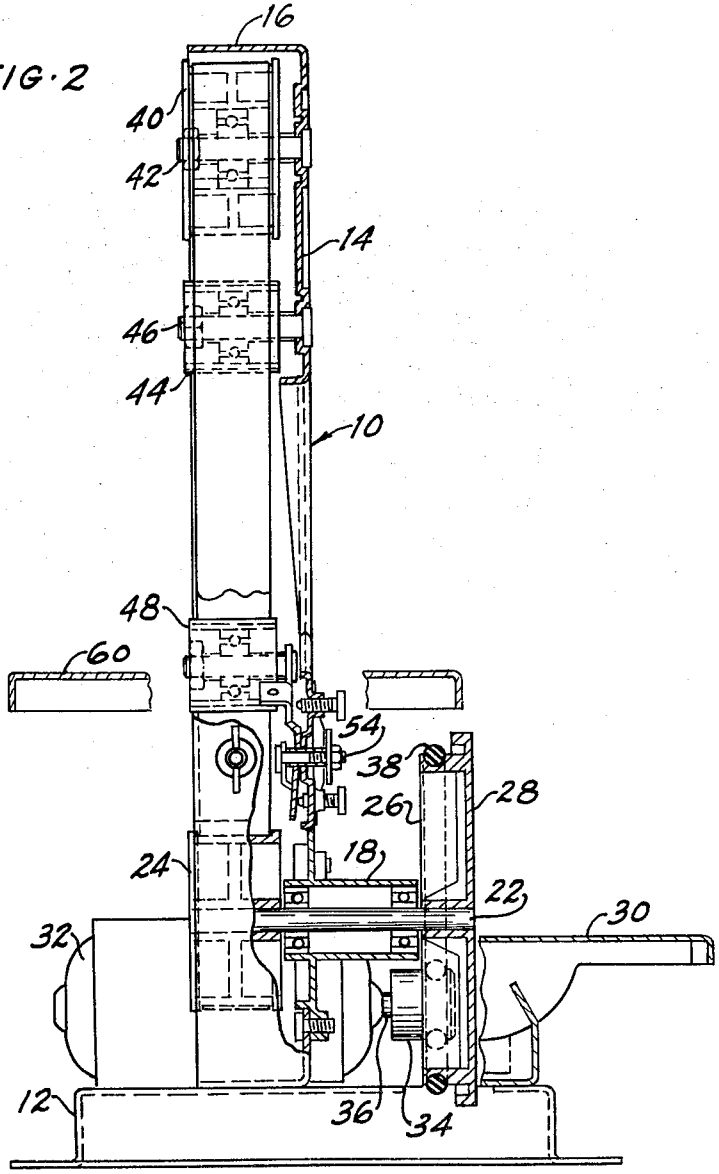
FIG. 2 is a front elevational view of the sanding machine shown in FIG. 1 with parts thereof sectionalized.

In the illustrated embodiment of the invention a sanding machine comprises a rigid upright frame generally indicated at 10 and a horizontal base 12 to which the frame 10 is suitably attached. The frame 10 comprises a rear wall 14 and sidewalls 16 and is open on the side shown in FIG. 1. A rigid housing 18 attached to a lower portion of the rear frame wall 14 by screws 19 journals a shaft 22 therein. Keyed to the left hand end of shaft 22 is a flanged drive pulley 24 and keyed to the right hand end thereof is a large diameter pulley 26 having a face 28 to which a sanding disc (not shown) may be attached for sanding workpieces supported on a worktable 30.

An electric motor 32 mounted on base 12 has a small diameter pulley 34 mounted on one end of its drive shaft 36 and a belt 38 extending over the small pulley 34 and the large diameter pulley 26 effects the driving of large pulley 26 and consequently the flanged drive pulley 24. The machine illustrated herein is a combination belt and disc sander.

Figures 3, 4, 5, 6:
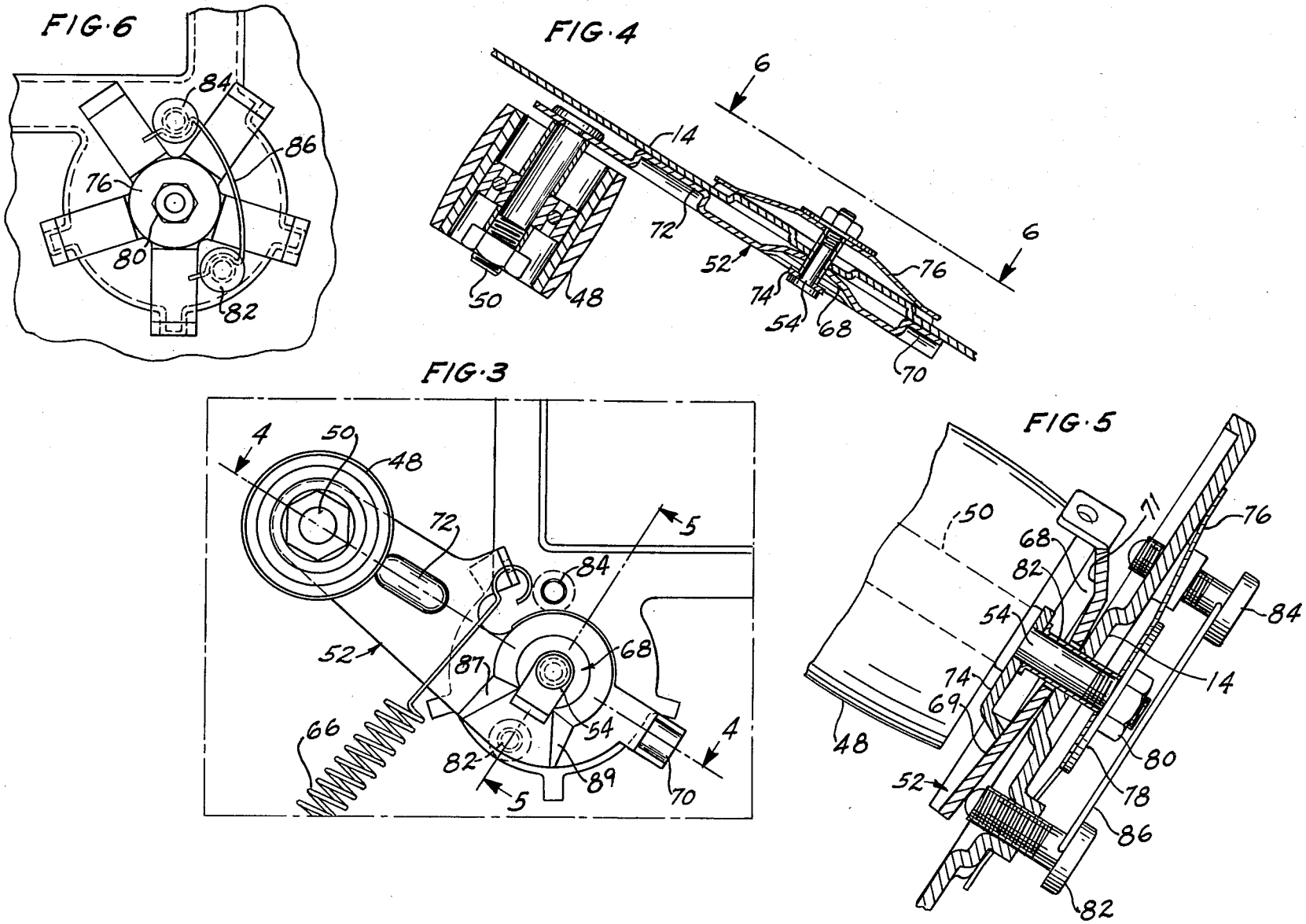
FIG. 3 is an enlarged elevational view of that portion of FIG. 1 enclosed in a dot-dash rectangle.
FIG. 4 is a cross-sectional view taken along line 4—4 of FIG. 3.
FIG. 5 is a further enlarged cross-sectional view taken along line 5—5 of FIG. 3.
FIG. 6 is a fragmentary elevational view taken along line 6—6 of FIG. 4.

A flanged idler pulley 40 is mounted for rotation on a shaft 42 fixed in the rear wall 14 of upright frame 10 near its upper end and an idler drum 44 of somewhat smaller diameter is mounted for rotation on a shaft 46 fixed in the rear frame wall 14 a short distance below idler pulley 40. A second idler drum 48 is mounted for rotation on a shaft 50 fixed in one end of a freely swinging generally flat arm 52. At its other end arm 52 is mounted for rotation on a bolt 54 passing through apertures in arm 52 and in the rear frame wall 14. The idler drum 48 has a crowned surface as shown in FIGS. 4 and 5.

A horizontal work surface 60 suitably attached to frame 10 is positioned between the lower drive pulley 24 and upper idler pulley 40. The drive pulley 24 and idler pulley 40 are of substantially equal diameter with their axes of rotation in substantially vertical alignment to the effect that one run 62 of an endless sanding belt 64 extending over these pulleys extends straight and substantially vertical between the pulleys. The drive pulley 24 is indicated as rotating clockwise so that the straight run 62 of the belt 64 is the downward run. A backing plate 63 detachably connected to the frame 10 by a bolt and wing nut 64 has a vertical surface lying against the inside surface of downward belt run 62.

The pivot bolt 54 of arm 52 is positioned between the downward and upward runs of the endless sanding belt 64, below the work surface 60 and a short distance above the drive pulley 24. The endless sanding belt 64 is of such length that its upward run 65 is deflected leftward considerably by engagement of the idler drum 48 with its inside surface when the idler drum 48 and arm 52 are swung to the position shown in solid line in FIG. 1. A spring 66 anchored at one end to the frame 10 and at its other end to freely swinging arm 52 maintains the desired tension on sanding belt 64 when in this solid line position.

Figure 1:
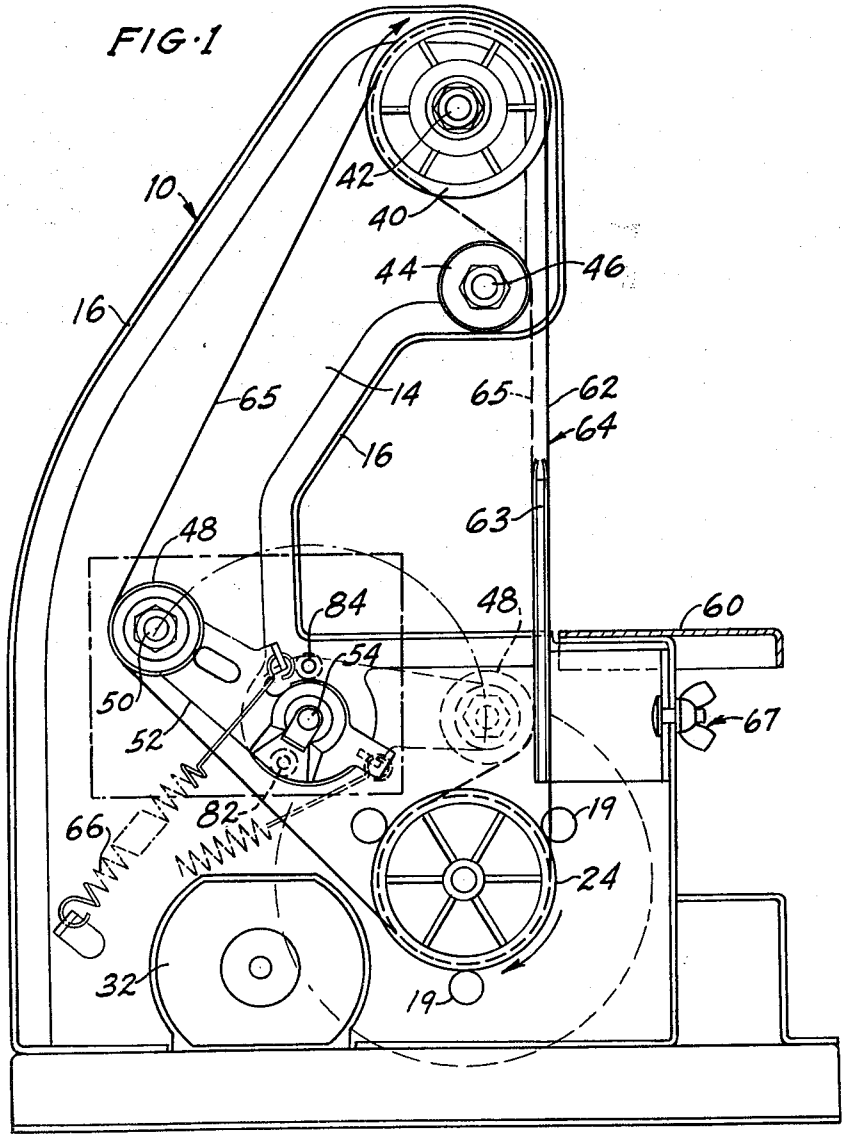
FIG. 1 is a side elevational view of a belt type sanding machine incorporating belt tracking mechanism constructed in accordance with the present invention.

When in this first position shown in solid line in FIG. 1, conventional sanding of the exterior surfaces of a workpiece placed on work support surface 60 may be carried on. However, when it is desired to sand internal surfaces of a workpiece, as when such surfaces form a closed loop defining an aperture or opening in the workpiece, the idler drum 48 is first swung clockwise to slack the belt 64 sufficiently to permit its removal from flanged idler pulley 40. This free end loop of the belt is passed through the aperture in the workpiece then replaced on pulley 40 and over the idler drum 44 as shown in dotted line. Idler drum 48 is then swung to its second position as shown in dotted line in FIG. 1 wherein it now contacts the opposite or abrasive side of run 65 of the belt 64. The length of arm 52, the location of its pivot point, the diameter of the idler drum 48 and the length of sanding belt 64 are such that clockwise rotation of arm 52 is limited by the belt to the position shown in dotted line in FIG. 1.

The upper idler drum 44 is so positioned and of such diameter that an intermediate portion of the upward run 65 of the belt between the swinging idler drum 48 and idler drum 44 is now held closely adjacent and substantially parallel with the downward belt run 62. The anchor point of spring 66 and its point of attachment to arm 52 are such that its point of attachment to arm 52 passes over center when arm 52 is rotated clockwise from its solid line to dotted line positions. The sanding belt is therefore suitably tensioned in both positions of the swinging idler drum.

Referring to FIGS. 3 to 6 of the drawings the generally flat arm 52 is constructed and arranged to rock or tilt about a longitudinal center line extending through the center of pivot bolt 54 and the center of drum shaft 50 whereby the drum shaft 50 may be tilted either way from a normal position parallel with the axes of rotation of the drive and idler pulleys. To facilitate this lateral tilting of the arm a circular portion of the arm surrounding the pivot bolt 54 is depressed forming a concavo-convex portion 68 with sloping sides 69 and 71 and with the convex side thereof resting on one side of the frame wall 14. Additional relatively narrow portions 70 and 72 of the arm spaced longitudinally along the longitudinal center line of the arm and on opposite sides of the pivot bolt 54 are similarly depressed to engage the one side of the frame wall so that the arm is otherwise spaced from the frame wall and so that the arm is constrained to tilt only about its longitudinal center line.

Referring to FIG. 5, the pivot bolt 54 extends through a clearance aperture in arm 52 with its head end projecting from the concave side of the depressed portion 68. Bolt 54 also extends through a more closely fitting aperture in the frame wall 14 with its screw threaded end projecting from the other side of the frame wall. A member 74 on bolt 54 attached to the head end thereof has a portion extending perpendicularly from the longitudinal center line of the arm and engages a sloping lateral extension 69 on the concave side of depression 68 at a point spaced radially from the pivot bolt 54. A spider spring 76 having its legs engaging the other side of the frame wall and its perforated center portion receiving the projecting screw threaded end of bolt 54 is held on the bolt and against the frame wall by a washer 78 and a nut 80.

A spacer sleeve 82 slipped over bolt 54 and extending between member 74 and washer 78 limits the biasing force which can be applied by spring 76 to arm 52 through member 74 when the nut 80 is tightened. When nut 80 is tightened against the spacer sleeve 82 the biasing force of spring 76 causes bolt 54 to move axially and thereby causes member 74 to tilt the arm 52 in one direction about its longitudinal center line therefore tilting the axis of rotation of swinging idler drum 48. An adjustment screw 82 threadedly engaged in the frame wall 14 is positioned so as to engage the convex side of the lateral extension of sloping side 69 at a point in line with the radially extending portion of member 74 when the arm is in its first or solid line position of FIG. 1 thereby to adjustably oppose the tilting of the arm in the one direction. A second adjustment screw 84 threadedly engaged in frame wall 14 is positioned so as to engage the convex side of the lateral extension of sloping side 69 at a point in line with the radially extending portion of member 74 to adjustably oppose the tilting of the arm in the one direction when the arm is in its second or dotted line position of FIG. 1.

The arm 52 and idler drum shaft 50 are shown in FIG. 5 in a normal position that is with the flat arm parallel to the frame wall and the shaft 50 perpendicular to the frame wall and parallel with the axes of rotation of pulleys 24 and 40. It will be seen that retraction of either of the adjustment screws 82 and 84 will permit increased tilting of arm 52 in the one direction by spring 76 and member 74. Also that advancement of either of the adjustment screws will reduce such tilting in the one direction and will cause the arm to be tilted in an opposite direction if either adjustment screw is advanced sufficiently. The depressed portion 68 of the arm 52 includes lateral ramps 87 and 89 to facilitate slipping over the adjusting screws when the arm 52 is swung from one position to the other. The radially extending portion of member 74 contacting the concave side of the lateral extension 69 lies between the lateral ramps 87 and 89 and the position of member 74 relative to the arm as the arm is swung from one position to the other is maintained by the ramps. The adjusted positions of screws 82 and 84 are retained by a formed wire spring 86, see FIG. 6.

From the foregoing it will be seen that the belt tracking mechanism described may be independently and diversely adjusted for the two positions of the idler drum and that such adjustments are re-established as the idler drum is swung to either of these positions from the other.

I claim:

1. In a belt sanding machine having a frame, drive and idler pulleys mounted for rotation in spaced relationship on said frame and an endless sanding belt extending over said pulleys, an arm having one end pivotally mounted on said frame and carrying an idler drum mounted for rotation on the other end thereof, said arm being tiltable about a longitudinal center line extending through its axis of rotation and the axis of rotation of said idler drum and having a normal position in which the axis of rotation of said idler drum is parallel with the axis of said pulleys, said idler drum being arranged to engage and tension said sanding belt at points between said pulleys when said arm is swung to either of two angularly spaced positions, belt tracking means for adjustably tilting the axis of rotation of said idler drum from its normal position comprising spring means acting to tilt said arm in one direction from its normal position and separate screw threaded means on said frame positioned so as to engage said arm and to adjustably oppose the tilting of said arm in said one direction when said arm is in either of its said two positions.

2. The belt sanding machine claimed in claim 1 in which said idler drum is arranged to engage opposite sides of one run of said sanding belt and to tension it oppositely when said arm is swung from one to the other of its said two positions, and in which at least one of said screw threaded means is operative to adjustably tilt said arm in a direction opposite to said one direction.

3. In a belt tensioning and tracking device, support structure including a wall, an arm having one end mounted for rotation on a pivot supported in said wall, and carrying an idler drum mounted for rotation on its other end, for engaging and tensioning a belt, said arm having relatively narrow portions thereof extending along its longitudinal center line in contact with said wall and portions extending laterally from said narrow portions spaced from said wall whereby said arm is tiltable about its longitudinal center line, spring means acting between said wall and one side of a laterally extending portion of said lever for tilting said arm in one direction about its longitudinal center line, and an adjustment screw threadedly engaged in said wall and positioned to engage the opposite side of said laterally extending portion of said arm to adjustably oppose the tilting of said arm in said one direction when said arm is swung to a belt tensioning position.

4. The belt tensioning and tracking device claimed in claim 3 which includes a second adjustment screw threadedly engaged in said wall and positioned to engage the opposite side of said laterally extending portion of said arm to adjustably oppose the tilting of said arm in said one direction when said arm is swung to a second angularly spaced belt tensioning position.

5. The belt tensioning and tracking device claimed in claim 3 in which said adjustment screw is operable to adjustably tilt said lever in an opposite direction about its longitudinal center line.

* * * * *